United States Patent [19]

Vornberger

[11] 3,934,294

[45] Jan. 27, 1976

[54] LASTING MACHINE AND METHOD

[75] Inventor: Walter Vornberger, Tewksbury, Mass.

[73] Assignee: International Shoe Machine Corporation, Nashua, N.H.

[22] Filed: Dec. 9, 1974

[21] Appl. No.: 530,927

[52] U.S. Cl. ..... 12/145; 12/12.5

[51] Int. Cl.[2] ..... A43D 21/00

[58] Field of Search ..... 12/145, 10.1–10.7, 12/12–12.5, 14.3

[56] References Cited

UNITED STATES PATENTS

| | | | |
|---|---|---|---|
| 3,105,983 | 10/1963 | Deschenes et al. | 12/10.1 |
| 3,359,586 | 12/1967 | Kamborian | 12/145 |
| 3,484,880 | 12/1969 | Bergeron | 12/145 |

*Primary Examiner*—Patrick D. Lawson
*Attorney, Agent, or Firm*—Albert Gordon

[57] ABSTRACT

A lasting machine having heel wipers, a support for supporting bottom-up a shoe assembly formed of a last having an upper mounted thereon and an insole located on its bottom in position to enable the heel wipers to wipe the heel portion of the upper margin against the insole, and side lasting instrumentalities so located as to wipe the side portions of the upper margin against the insole.

6 Claims, 21 Drawing Figures

FIG. 15
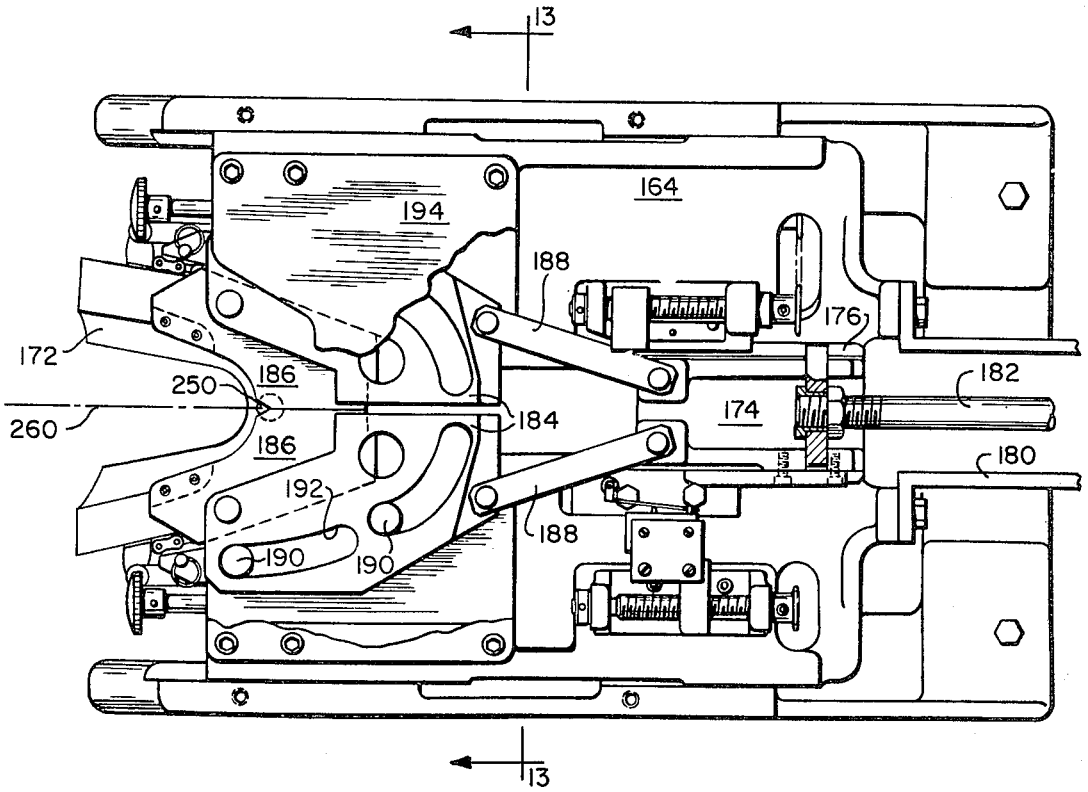
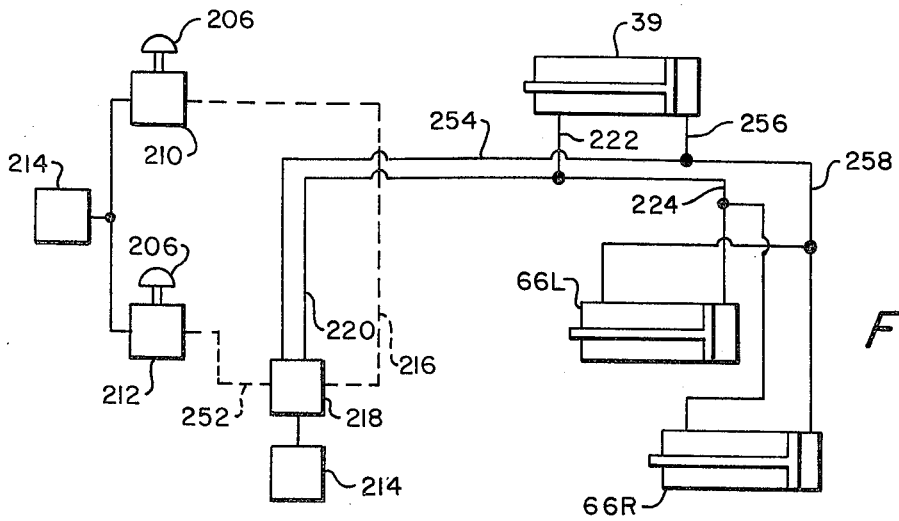
FIG. 16

LASTING MACHINE AND METHOD

BACKGROUND OF THE INVENTION

There is disclosed in pending application Ser. No. 467,522 filed May 6, 1974 a machine for lasting the heel and side portions of a shoe assembly formed of a last having an upper mounted thereon and an insole located on its bottom while the shoe assembly is supported bottom-up on a support means. The machine includes heel wiping means that are symmetrically disposed about a forwardly-rearwardly extending line of symmetry and that are mounted for forward movement from a retracted position to an advanced position in a heel wiping stroke. The support means so supports the shoe assembly that the heel portion of the shoe assembly faces the heel wiping means and is located forwardly of the heel wiping means when the heel wiping means is in its retracted position so that the heel wiping stroke cause the heel wiping means to wipe the heel portion of the margin of the upper against the insole. The support means is so constructed as to enable the heel portion of the shoe assembly to be shifted transversely of said line of symmetry. A base is located outwardly of and on each side of the support means and forwardly of the heel wiping means, each base being mounted for inward movement in a base stroke from an outer base position to an inner base position. Manually operable limit-stop means are provided that adjust the inner base position of each base. A side lasting instrumentality, mounted to each base for inward-outward movement, is so constructed as to enable it when it is moved inwardly of an outer position on its base to perform operations that include engaging its associated side portion of the shoe assembly and wiping the margin of its associated side portion of the upper against the insole. Control means are provided that are actuable to selectively shift the support means so as to shift the heel portion of the shoe assembly in a particular direction that is transverse to said line of symmetry.

In the operation of this machine, the heel wiping means is initially maintained in its retracted position, the bases are initially maintained in their outer base positions, and the side lasting instrumentalities are initially maintained in outer positions with respect to their associated bases. This is followed by an actuation of said control means which is followed by a movement of each base through its base stroke which, in turn, is followed by a movement of each side lasting instrumentality inwardly of its outer position with respect to its associated base to perform said operations on the shoe assembly. After said actuation of the control means, a heel wiping stroke is imparted to the heel wiping means.

It is desirable that the heel portion of the shoe assembly be symmetrically related to said line of symmetry during the heel wiping stroke. It is known, as disclosed in U.S. Pat. No. 3,609,785, to provide a mechanism in a heel lasting machine for shifting the heel portion of a shoe laterally to bring it into symmetry with the heel wiping means of the machine when changing from a left foot shoe assembly to a right foot shoe assembly or vice versa.

SUMMARY OF THE INVENTION

It is desirable, when the control means are actuated to shift the heel portion of the shoe asembly, that the heel portion be so shifted as to bring the heel portion of the shoe assembly into symmetrical relationship with respect to said line of symmetry. When this is done, one side of the shoe assembly is positioned further from said line of symmetry than the other side of the shoe assembly. At the conclusion of the base strokes the side lasting instrumentalities should be spaced approximately the same distances outwardly from their associated sides of the shoe assembly and, in accordance with a first aspect of this invention, the base strokes are automatically adjusted to provide for this desired relationship.

In accordance with the first aspect of this invention, limit stop means are associated with each base for so adjusting its associated inner base position that the inner base position of its associated base may be in close inner base location that is relatively close to said line of symmetry or in a remote inner base location that is relatively remote from said line of symmetry and the actuation of the control means, in addition to transversely shifting the heel portion of the shoe assembly in a particular direction that is transverse to said line of symmetry and that points to a particular side of said line of symmetry, also actuates the limit stop means so as to place the inner base position of the base on said particular said of said line of symmetry in its close location and the inner base position of the other base in its remote location.

A second aspect of this invention is concerned with an improved arrangement for transversely shifting the heel portion of the shoe assembly so as to bring the heel portion of the shoe assembly into a symmetrical relationship with the heel wiping means. For this purpose, the machine incorporates a housing that is mounted for swinging movement about an upright axis and the support means is mounted to the housing forwardly of this axis in such a position that the heel of the shoe assembly on the support means faces the heel wiping means and is located forwardly of the heel means with the heel wiping means is in its retracted position and the heel end of the shoe assembly is in approximate coincidence with this axis. In accordance with this aspect of the invention, the housing is swung about this axis to bring the heel portion of the shoe assembly into symmetrical relationship with said line of symmetry.

BRIEF DESCRIPTION OF THE DRAWINGS

FIG. 15 is a plan view of the heel wiping means and the operating mechanism therefor;

FIG. 16 is a schematic representation of a portion of the machine control circuit;

DESCRIPTION OF THE PREFERRED EMBODIMENT

Figure 1:
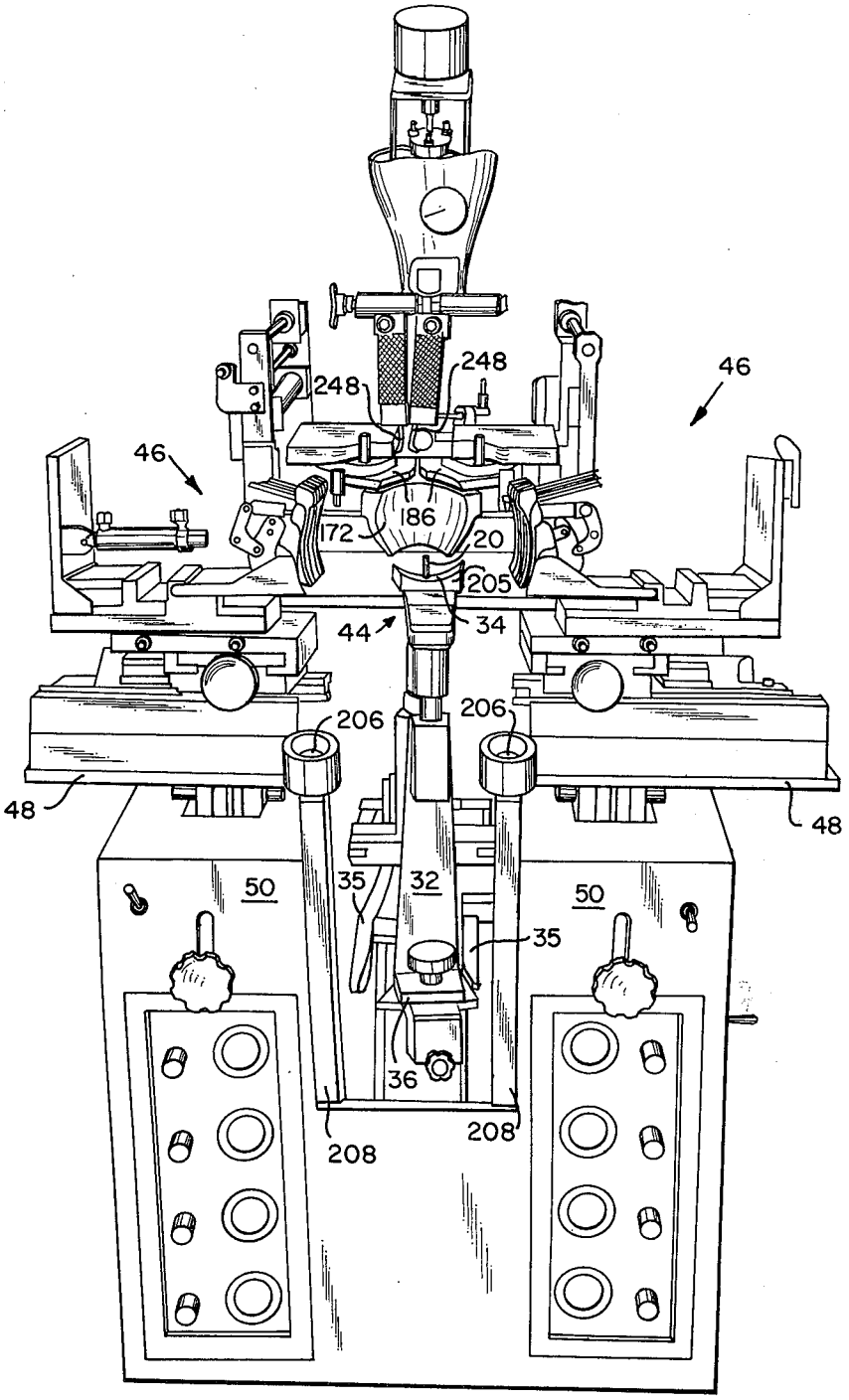
FIG. 1 is a front elevation of the machine.
Figure 9:
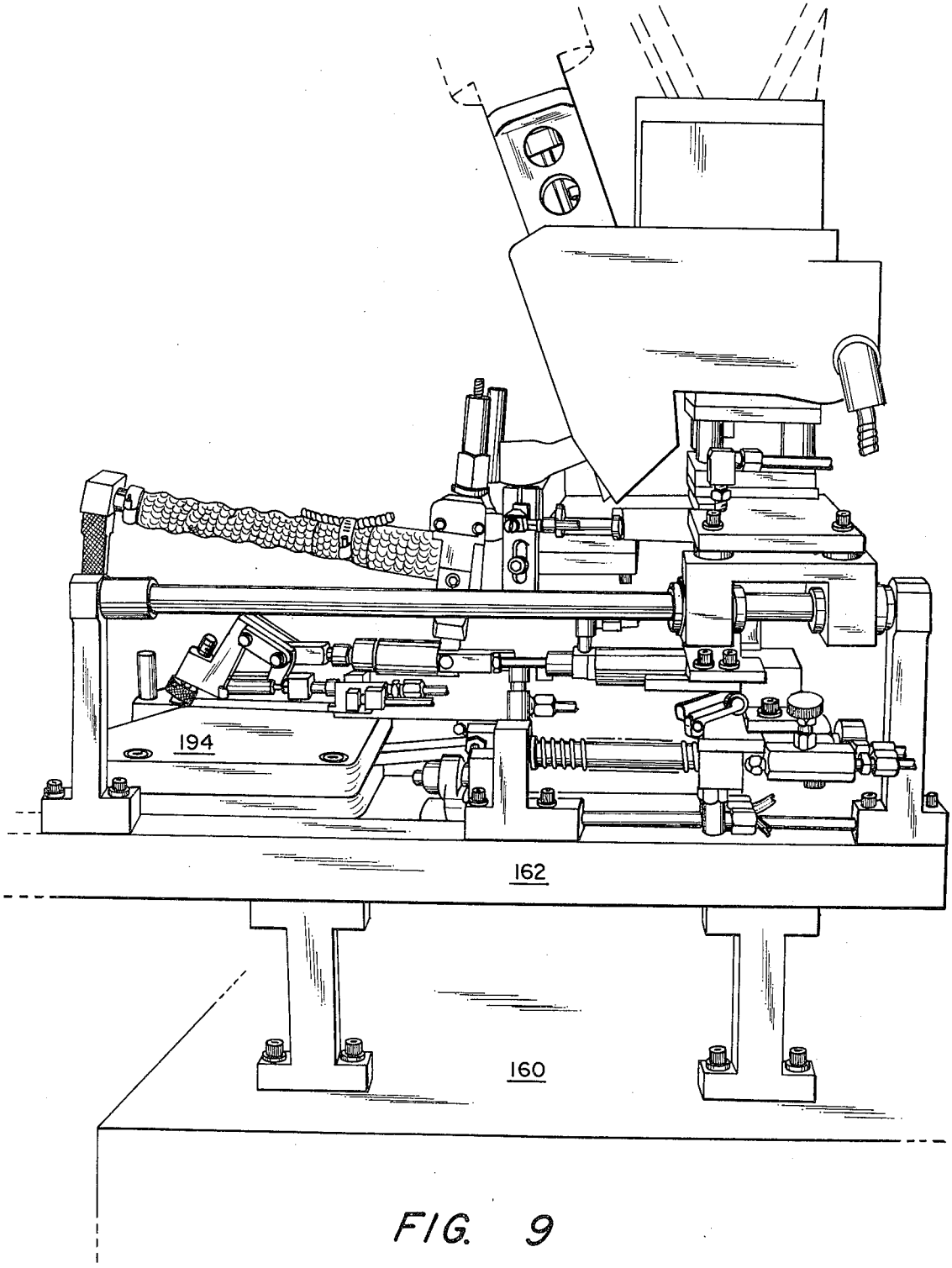
FIG. 9 is a side view of a portion of the machine.
Figure 10:
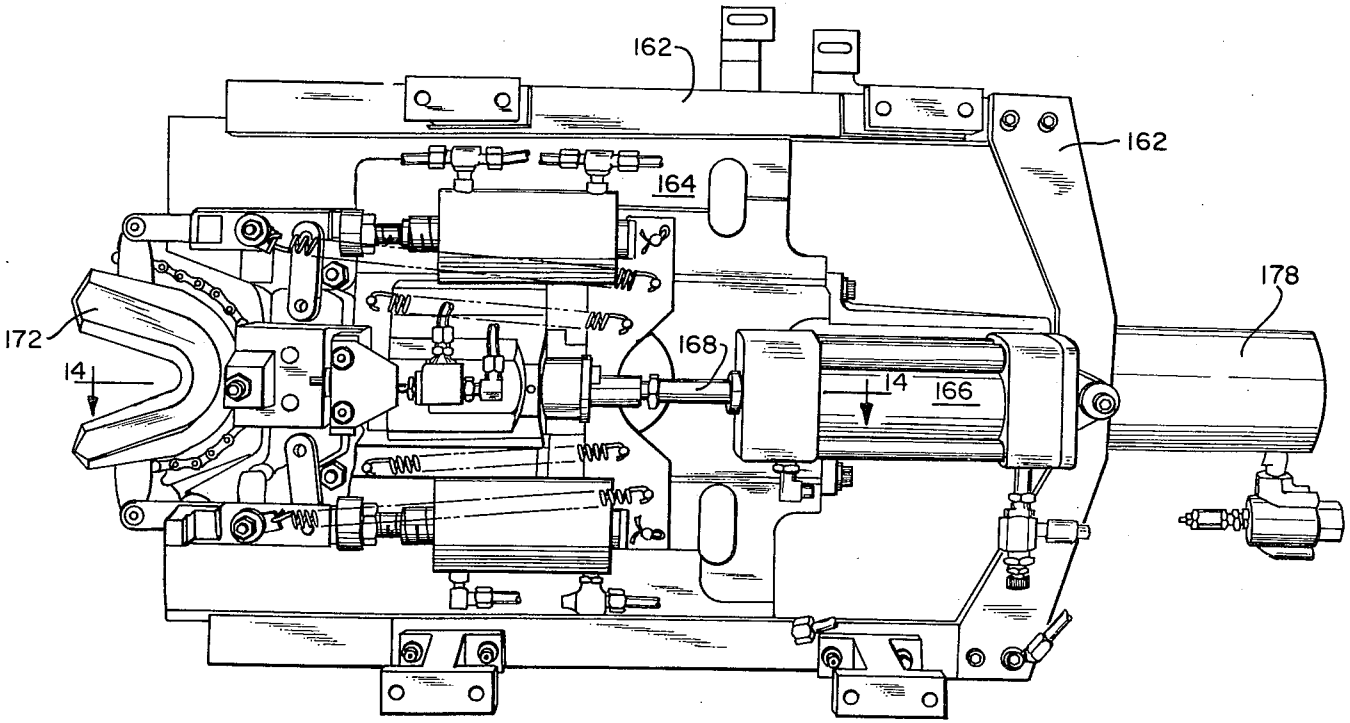
FIG. 10 is a bottom view of the heel wiping means and an operating mechanism therefor.
Figure 11:
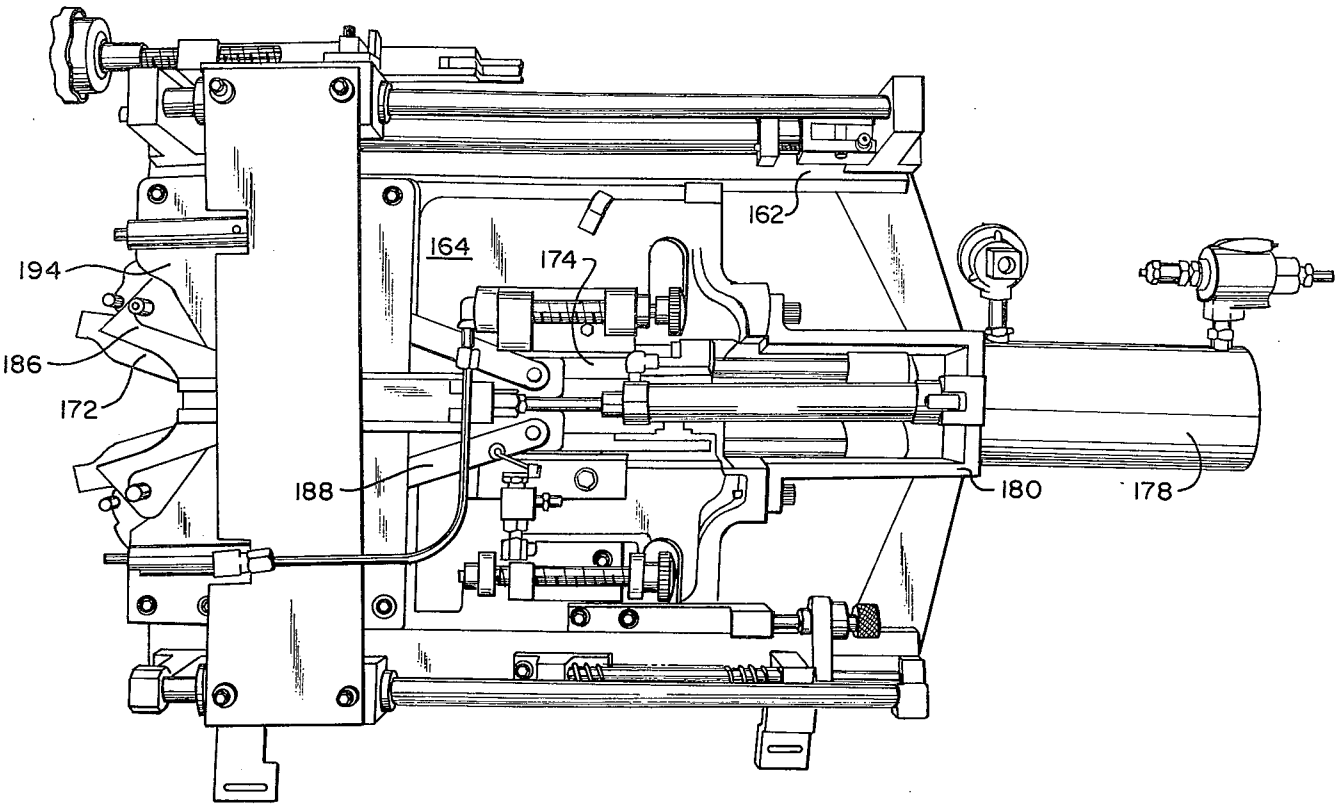
FIGS. 11 and 12 are top views of the heel wiping means and the operating mechanism therefor.
Figure 12:
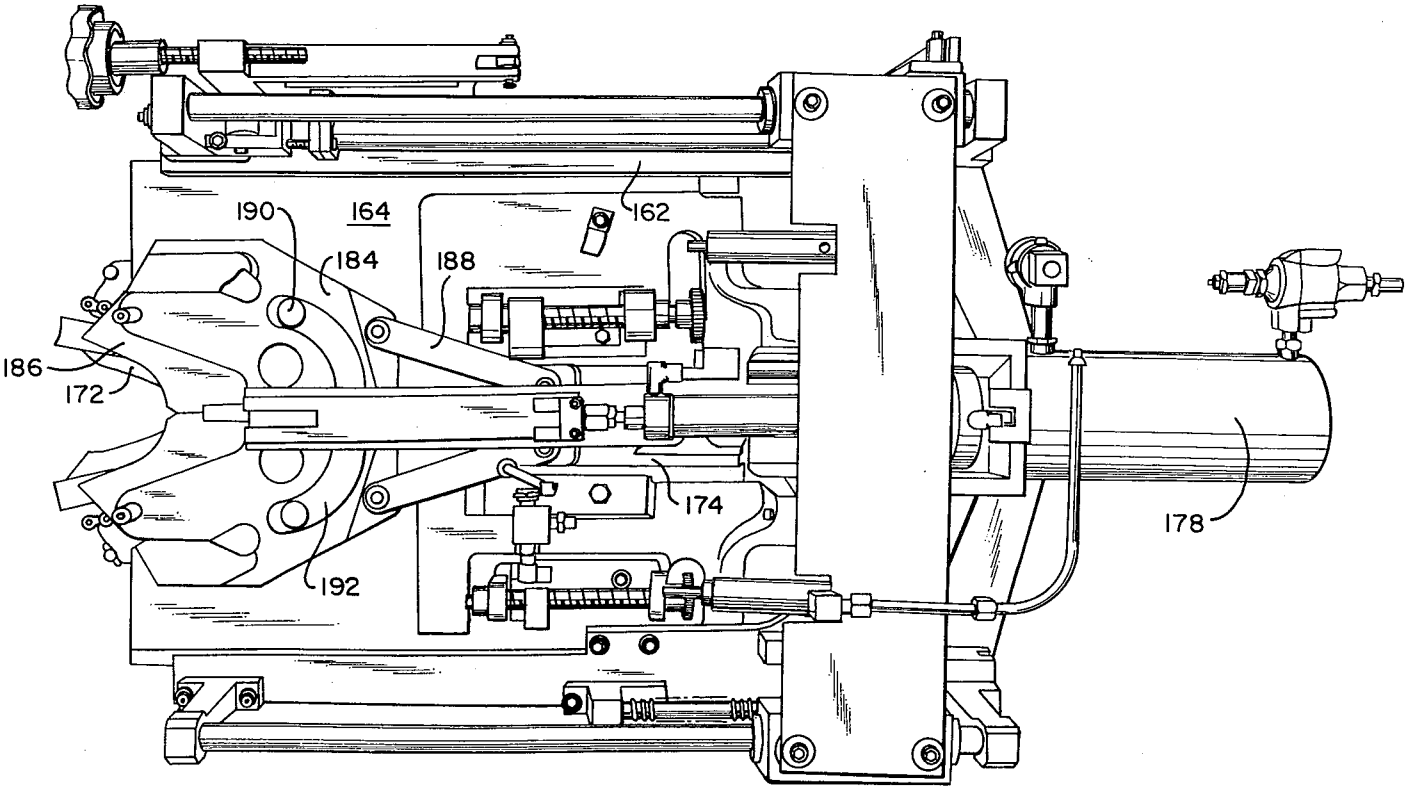
Figure 13:
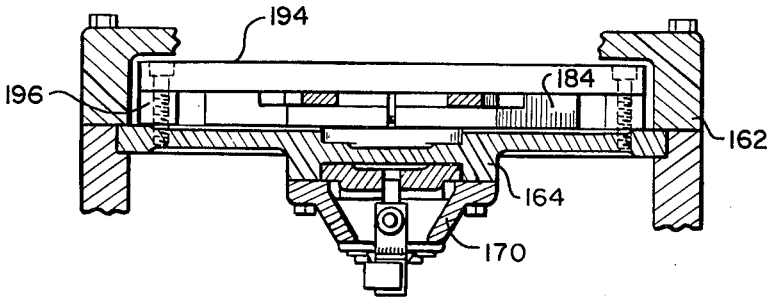
FIG. 13 is a view taken on the line 13—13 of FIG. 15.
Figure 14:
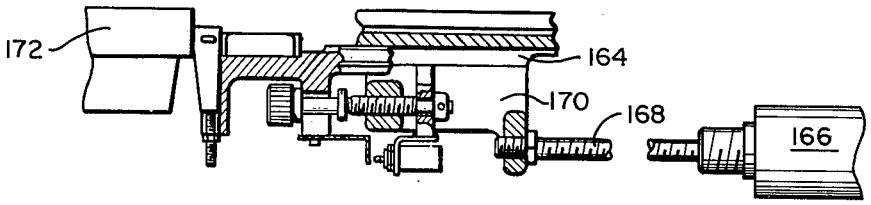
FIG. 14 is a view taken on the line 14—14 of FIG. 10.

The operator is intended to stand in front of the machine as seen in FIG. 1 and to the left of the machine as seen in FIG. 9. Directions extending towards the operator (right to left in FIG. 9) will be designated as "forward" and directions extending away from the operator (left to right in FIG. 9) will be designated as "rearward". The front of the machine is closest to the operator and the back of the machine is furthermost from the operator.

Figure 2:
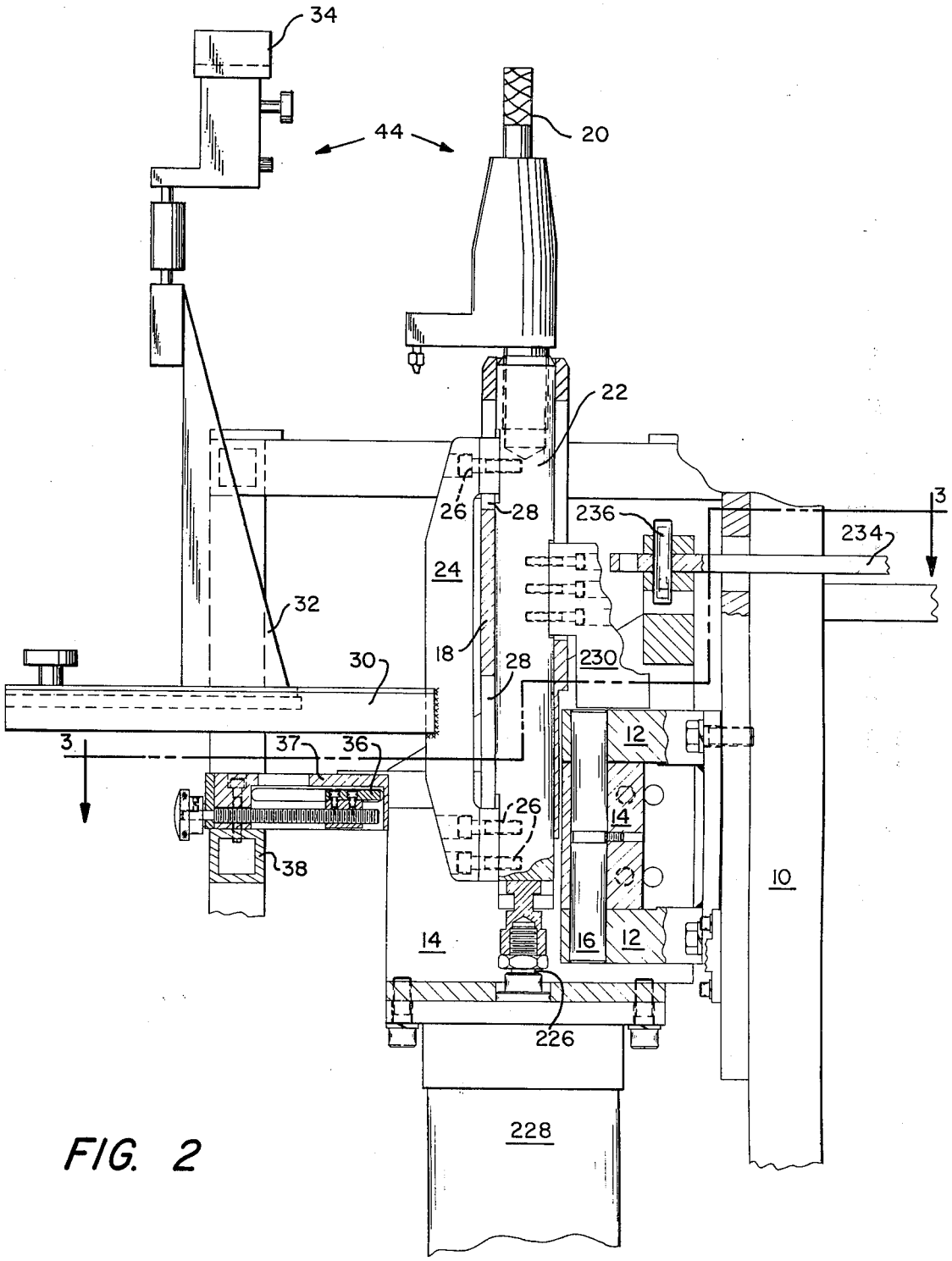
FIG. 2 is a partially sectional elevation of the support means of the machine.
Figure 3:
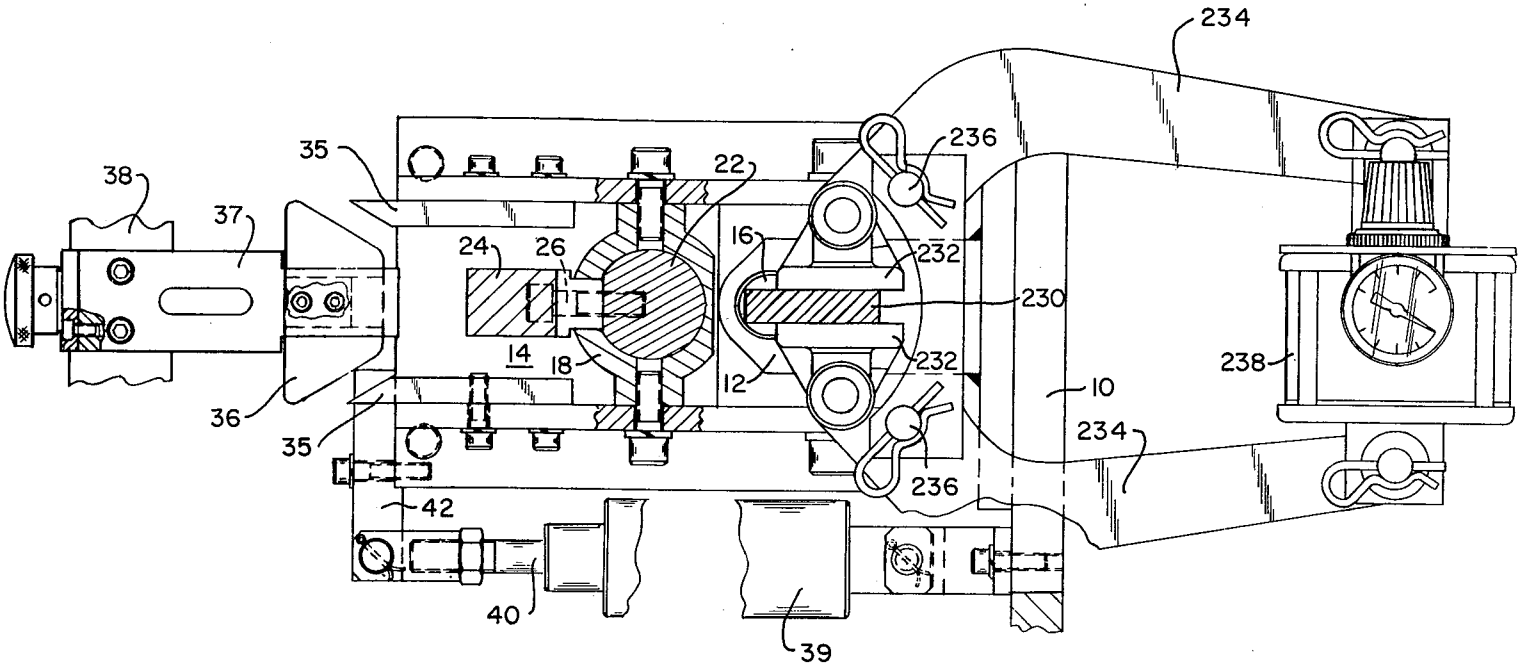
FIG. 3 is a view taken along the line 3—3 of FIG. 2.

Referring to FIGS. 2 and 3, the machine frame includes a bracket 10 having flanges 12 bolted thereto. A housing 14 is pivoted to the flanges 12 by means of a pivot pin 16 for swinging movement about the vertical axis of the pin 16. A sleeve 18 is located on the housing 14 forwardly of the pivot pin 16. A last pin 20 is secured to the top of a bar 22 that is mounted for heightwise movement in the sleeve 18. A flange 24 is mounted to the front of the bar 22 by means of screws 26 that connect the flange 24 and the bar 22 and that extend through slots 28 in the sleeve 18. A plate 30 is mounted to and extends forwardly of the flange 24 and a column 32 is secured to and extends upwardly of the plate 30. A toe rest 34 is mounted to the top of the column 32 and is located forwardly of the last pin 20. A pair of forwardly directed wings 35 are mounted to the housing 14 and are located on opposite sides of a cam 36. The cam 36 is mounted to a bracket 37 for forward-rearward adjustment and the bracket 37 is secured to a cross piece 38 of the machine frame. An air actuated motor 39, pivoted to the bracket 10, has a forwardly directed piston rod 40 that is pivoted to a lug 42 of the housing 14.

The last pin 20 and the toe rest 34 constitute a work support 44 for supporting a shoe assembly that is described below.

Figure 4:
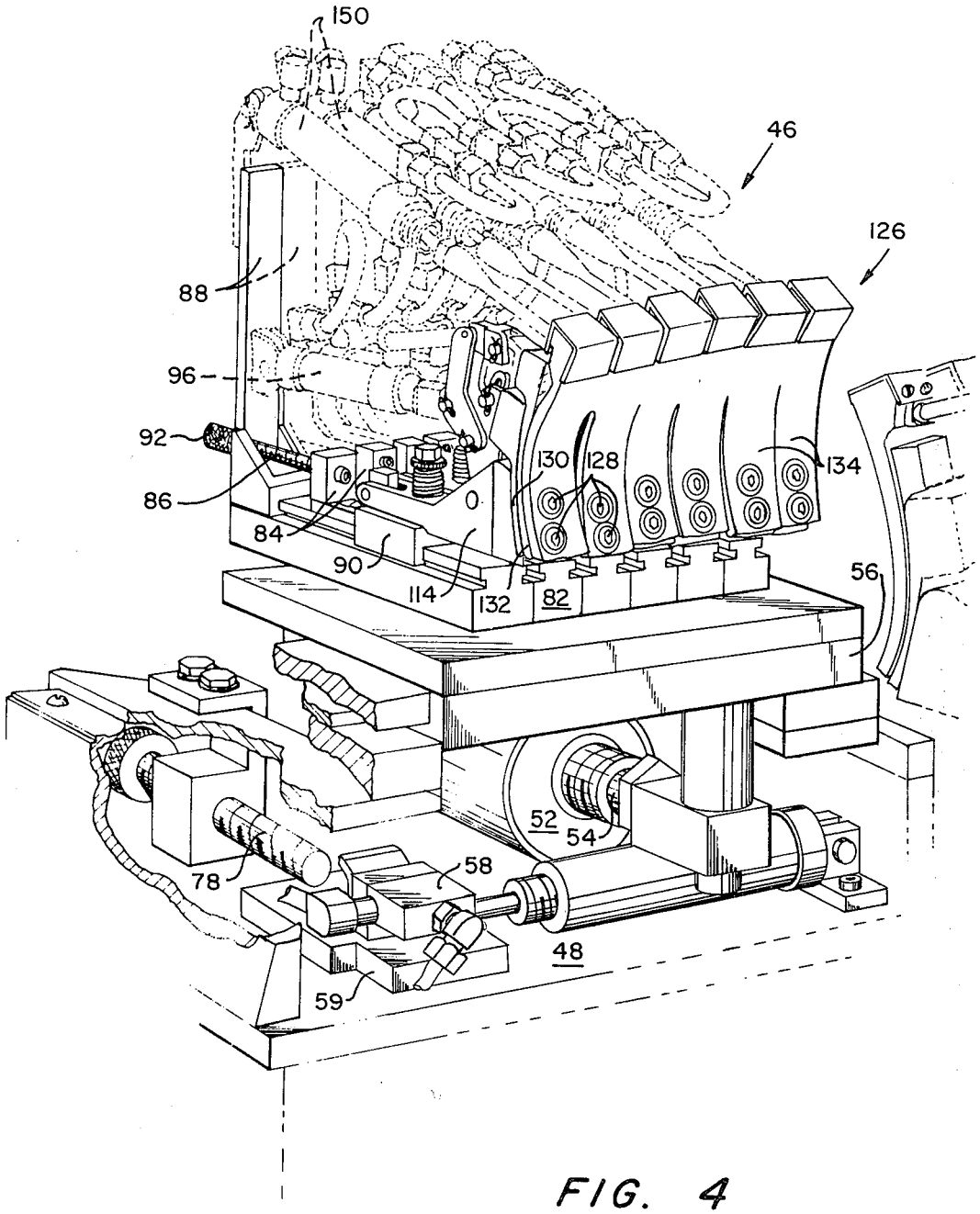
FIG. 4 is an isometric view of a set of side lasting instrumentalities.
Figure 5:
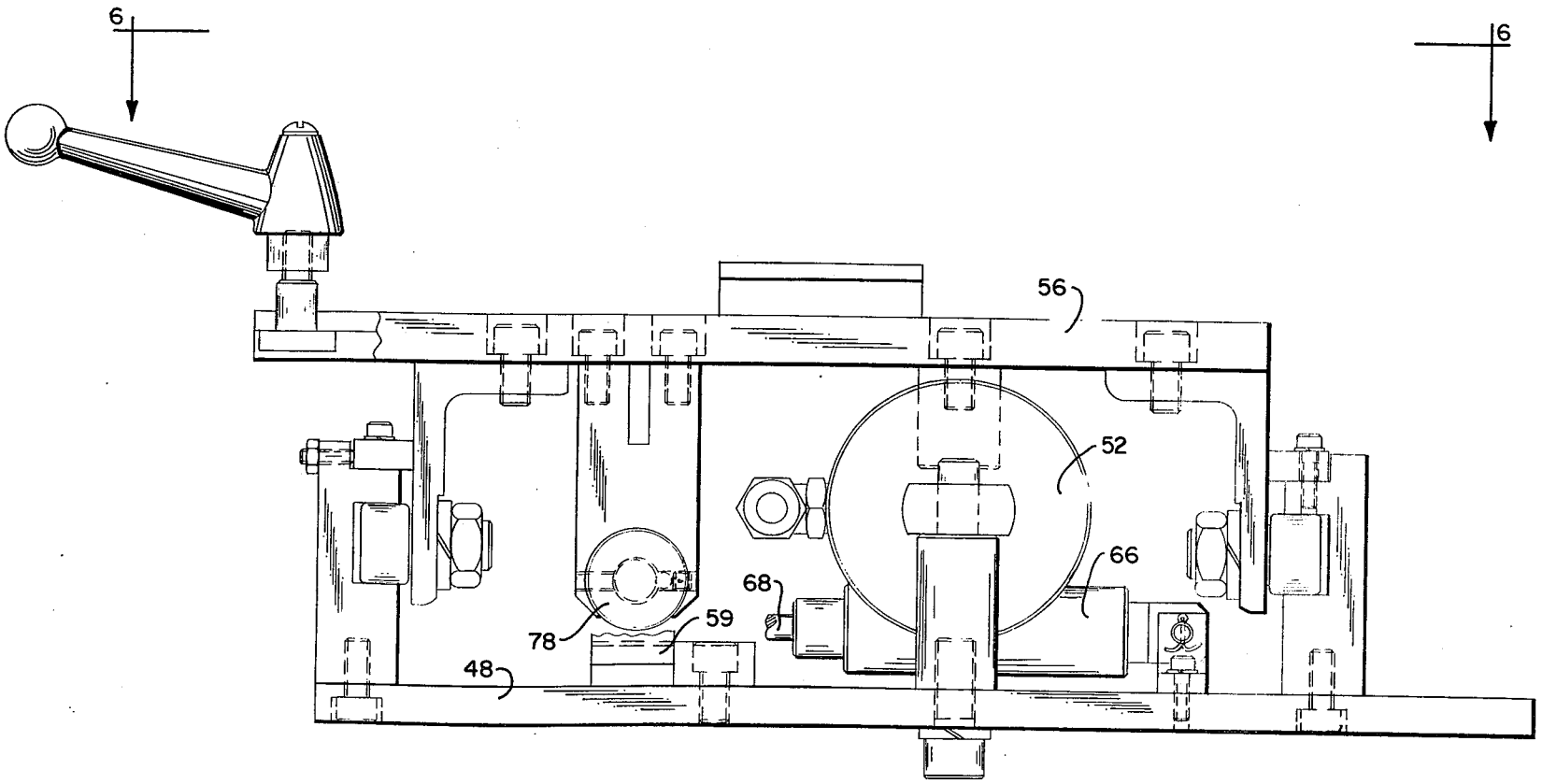
FIG. 5 is an elevation of a base and a mechanism for effecting a base stroke.
Figure 6:
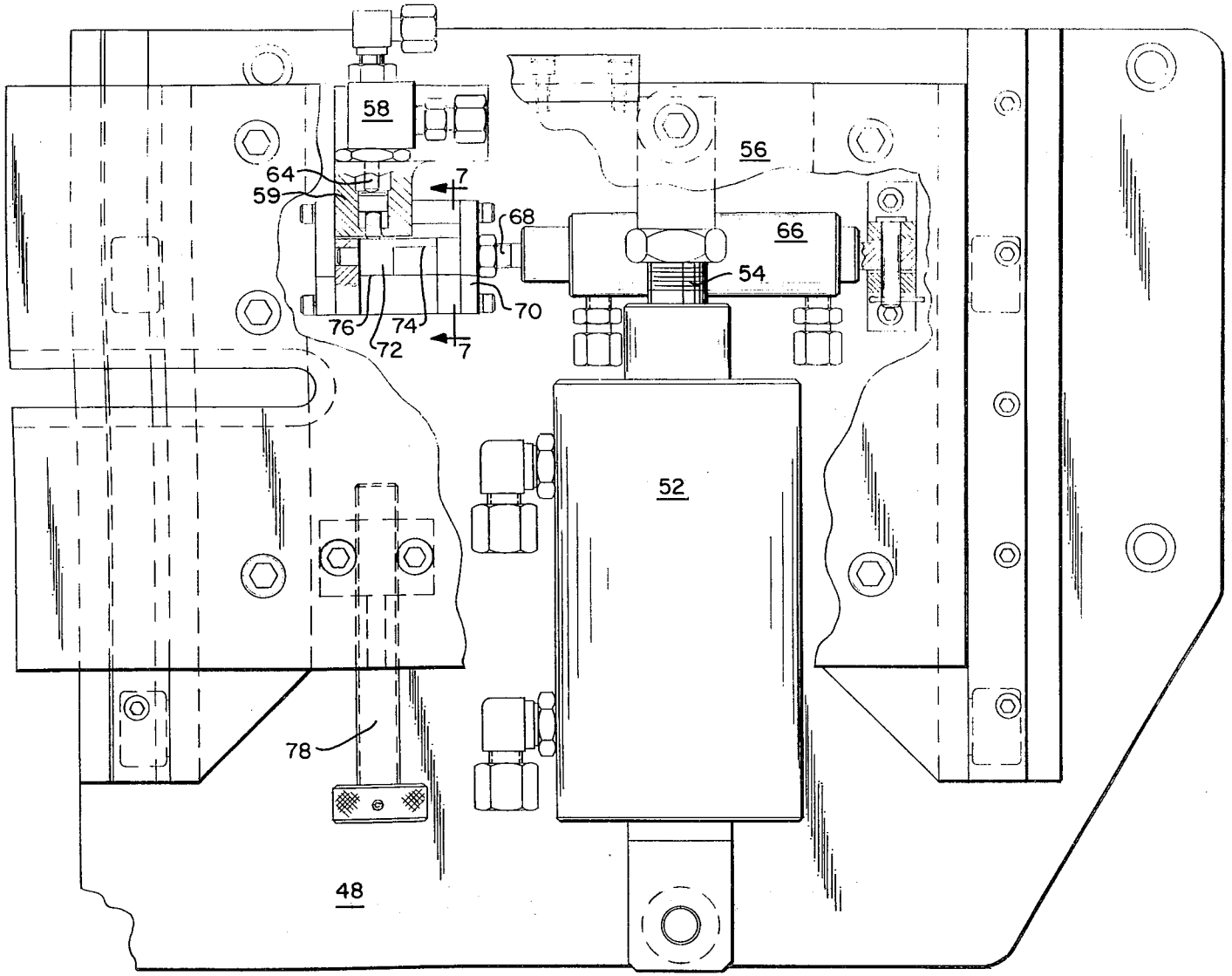
FIG. 6 is a plan view taken along the line 6—6 of FIG. 5.
Figure 7:
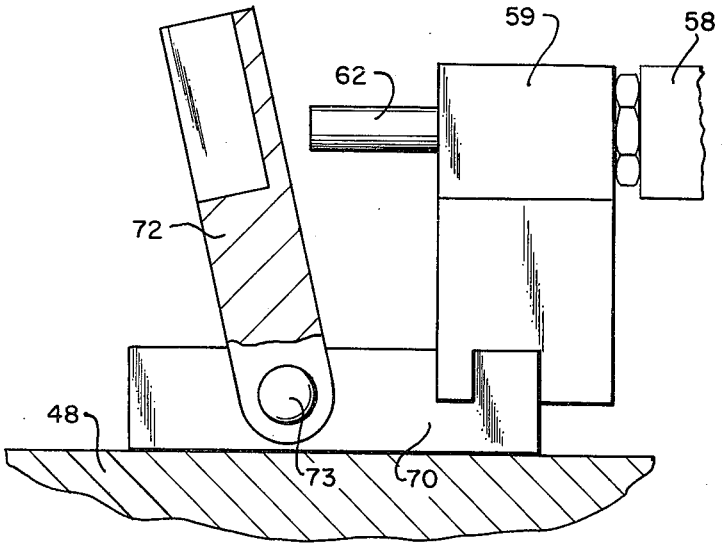
FIG. 7 is a view taken along the line 7—7 of FIG. 6.

Duplicate sets of lasting units 46 (see FIG. 1) are located on opposite sides of the work support 44. Referring to FIGS. 4–6, each set of lasting units 46 is mounted for inward-outward movement on a table 48 that is mounted to the machine frame 50 (see FIG. 1). An air actuated motor 52, mounted to each table 48, has a piston rod 54 that is secured to a base 56 of a set of lasting units 46 to thereby enable the motors 52 to effect inward-outward movement of the lasting units 46.

A valve 58 is mounted to each table 48 by means of a housing 59 that is anchored to its associated table. A pin 62 is mounted in each housing 59 for inward-outward movement, each pin 62 being located outwardly of the spindle 64 of its associated valve 58. An air actuated motor 66, mounted to each table 48, has a piston rod 68 that is secured to a plate 70. Each plate 70 is slidably supported on a table 48 and is slidably mounted to its associated housing 59 for forward-rearward movement. A valve actuating lever 72 is pivoted by a pin 73 to each plate 70 so as to extend outwardly of and in registration with its associated pin 62. Each lever has an inner section 74 and an outer section 76, the outer sections being located outwardly of the inner sections. A rod 78 is so mounted to each base 56 as to be outward of its associated lever 72 and in registry with its associated pin 62.

Figure 8:
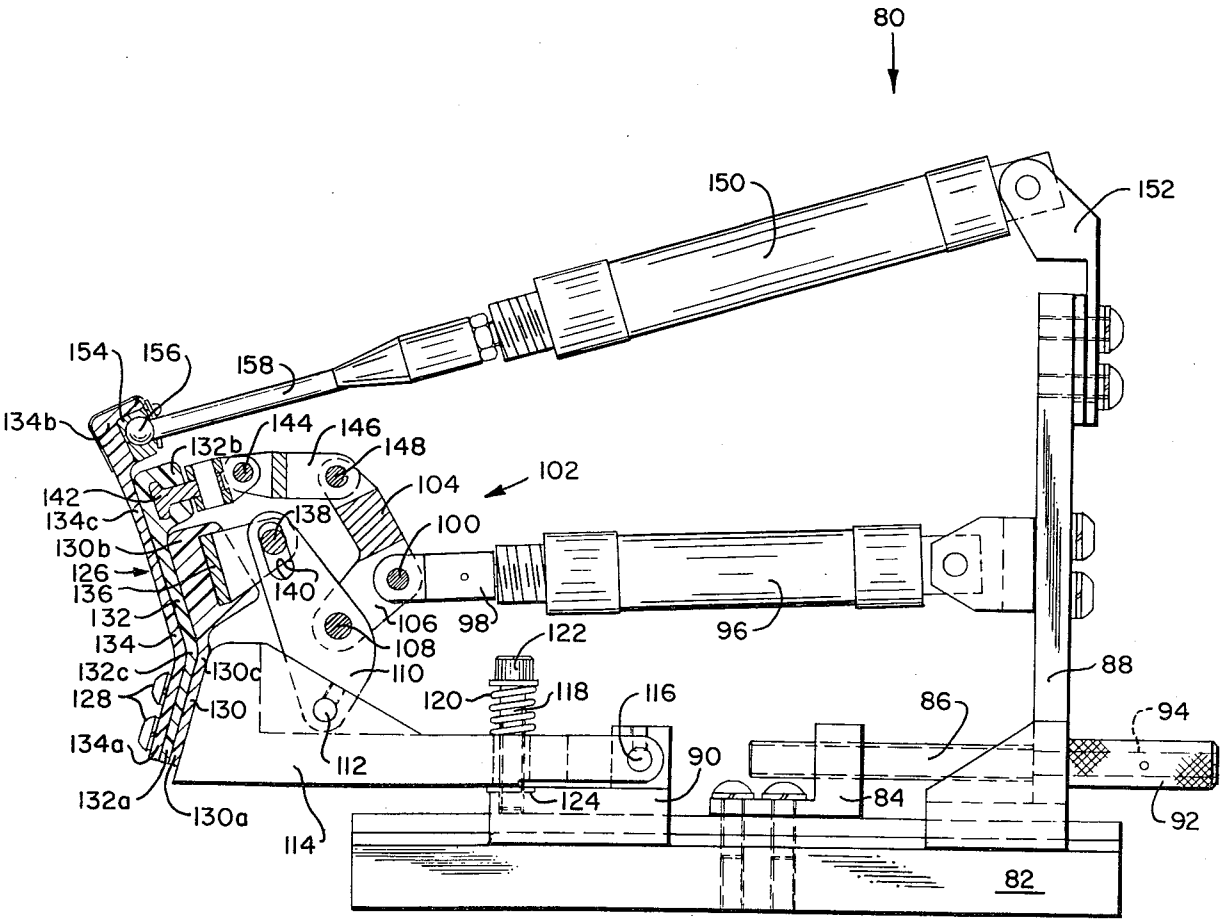
FIG. 8 is a partially sectional view of a side lasting instrumentality.

Referring to FIGS. 4 and 8, each set of lasting units 46 is formed of a plurality of lasting units 80 located side by side that are mounted to a support 82 that is secured to and is located above a base 56. A flange 84 for each lasting unit 80 is secured to and extends upwardly of a support 82 and threadedly receives a bolt 86. Each bolt 86 extends through an outer slide bracket 88, forming a part of a lasting unit 80, that is slidably mounted to a support 82 for inward-outward movement. Each lasting unit 80 includes an inner slide bracket 90 that is mounted to a support 82 for inward-outward movement. A knob 92 is pinned to the outer end 94 of each bolt 86, the outer ends 94 being of smaller diameter than the threaded portions of the bolts 86. The brackets 88 are located between the shoulders located at the juncture of the larger and smaller diametered portions of the bolts 86 and shoulders formed at the inner ends of the knobs 92. Due to the connection between the outer brackets 88 and the inner brackets 90, described below, rotation of the knobs 92 in one direction or the other will cause inward or outward movement of the brackets 88, 90 along the supports 82 and thus cause inward or outward movements of the lasting units 80.

An air operated motor 96 is pivoted to each outer bracket 88 and extends inwardly thereof. The piston rod 98 of each motor 96 is pivoted by a pin 100 to the middle of a lever 102. Each lever 102 has an upper limb 104 and a lower limb 106, the limbs extending inwardly of the pin 100. Each limb 106 is pivoted by a pin 108 to a lever 110. The bottom of each lever 110 is pivoted by a pin 112 to a block 114 for inward-outward movement about the axis of the pin 112. Each block 114 is pivoted for heightwise movement to an inner slide bracket 90 by a pin 116. A shaft 118, mounted to and upstanding from each bracket 90 inwardly of its associated pin 116, extends through its associated block 114. Compression springs 120 are entwined about the shafts 118 and extend between the tops of the blocks 114 and collars 122 mounted to the tops of the shafts 118. The springs 120 yieldably urge the blocks 114 downwardly about the axes of the pins 116 to positions wherein the bottoms of the blocks 114 engage collars 124 that are mounted to the shafts 118 beneath the blocks 114.

A side lasting instrumentality 126 is anchored to each block 114 by bolts 128. Each lasting instrumentality 126 is formed of three plies, the outer ply being an outer presser strap 130, the middle ply being an inner presser strap 132, and the inner ply being a lasting strap 134. The straps 130, 132 and 134 are made of an elastic, flexible and deformable material such as urethane. The straps 130, 132 and 134 respectively have bottom segments 130*a*, 132*a* and 134*a* that are rigid by virtue of being secured to the block 114 by the bolts 128. The top of each lasting strap 134 is formed into a thickened relatively rigid top segment 134*b*. The middle segment 134*c* of the lasting strap 134, between the bottom segment 134*a* and the top segment 134*b*, is flexible, deformable and stretchable.

The top of each inner presser strap 132 is formed into a thickened relatively rigid top segment 132*b* that is located below its associated lasting strap top segment 134*b*. The middle segment 132*c* of the inner presser strap 132, between the bottom segment 132*a* and the top segment 132*b*, is flexible, deformable and stretchable.

The top of each outer presser strap 130 is formed into a thickened relatively rigid top segment 130*b* that is located below its associated inner presser strap top segment 132*b*. The middle segment 130*c* of the outer presser strap 130*c* of the outer presser strap 130, between the bottom segment 130*a* and the top segment 130*b* is flexible, deformable and stretchable.

A lug 136, embedded in the outer presser strap top segment 130*b*, has a pin 138 mounted thereto that is slidably received in a slot 140 formed at the top of each lever 110.

A lug 142, embedded in the inner presser strap top segment 132*b*, is pivoted by a pin 144 to a link 146, and each link 146 is pivoted by a pin 148 to the top of its associated limb 104.

An air operated motor 150 is associated with each lasting instrumentality 126. Each motor 150 is pivoted to a bracket 152 that is secured to the top of each outer bracket 88. The motors 150 extend inwardly of the brackets 152. A socket 154 is embedded in each lasting strap top segment 134*b*. Each socket 154 rotatably receives a ball 156 that is mounted to the inner end of the piston rod 158 of its associated motor 150 to thereby provide a flexible connection between the piston rods 158 and the lasing strap top segments 134*b*.

Referring to FIGS. 9–15, a platform 160 is located rearwardly of the support 44 and the lasting units 46. A head 162 is mounted to and is located above the platform 160. A main slide plate 164 is slidably mounted in the head 162 for forward-rearward movement. A fluid actuated motor 166, mounted to the head 162, has a piston rod 168 connected to a bracket 170 mounted to the slide plate 164 to effect this movement. A heel clamp 172 is mounted to the main slide plate 164 in the manner disclosed in the aforementioned application Ser. No. 467,522.

Referring to FIGS. 11, 12, 13 and 15, a wiper slide 174 is slidably mounted for forward and rearward movement in guideways 176 formed in the upper surface of the main slide plate 164. An air actuated motor 178 is mounted to a bracket 180 that is secured to and extends rearwardly of the main slide plate 164. The piston rod 182 of the motor 178 is connected to the wiper slide 174 so that activation of the motor 178 will cause the wiper slide 174 and all components carried thereon to move forwardly or rearwardly in the guideways 176. Slidably mounted to the upper surface of the forward end of the main slide plate 164 are a pair of wiper cams 184 to which are mounted heel wipers 186. The heel wipers 186 are symmetrically disposed about the forward-rearward axis of the machine. A pair of links 188 pivotally connect the wiper slide 174 and the wiper cams 184 so that motion may be transmitted to the wiper cams 184 and consequently the wipers 186 upon actuation of the wiper slide 174 by the motor 178. For the purpose of guiding the wiper cams 184 in a desirable predetermined path, rollers 190 are rotatably mounted to the main slide plate 164 and protrude upwardly into cam slots 192 formed in the wiper cams 184 for accommodation of the rollers 190. The wiper cams 184 are maintained in sliding contact with the main slide plate 164 by means of a cover 194 which is bolted to the main slide plate 164 and is spaced therefrom by means of spacers 196 (FIG. 13), the spacing between the main slide plate 164 and the cover 194 being such that the wiper cams 184 may have horizontal sliding motion only, there being insufficient clearance for allowance of any substantial vertical movement.

In the idle condition of the machine: the piston rods 54 are retracted into the motors 52 to thus force the bases 56 into outer positions and thus position the sets of lasting units 46 in outer positions wherein they do not interfere with the placement of a shoe assembly on the support 44 as described below; the piston rods 98 are retracted into the motors 96 and the piston rods 158 are retracted into the motors 150 thus placing the lasting instrumentalities 126 in outer positions on the supports 82; the piston rod 168 is retracted into the motor 166 to maintain the main slide plate 164 and the parts carried thereby in a rearward position; and the piston rod 182 is retracted into the motor 178 to thereby maintain the wipers 186 in the retracted position shown in FIG. 15.

Figure 17:
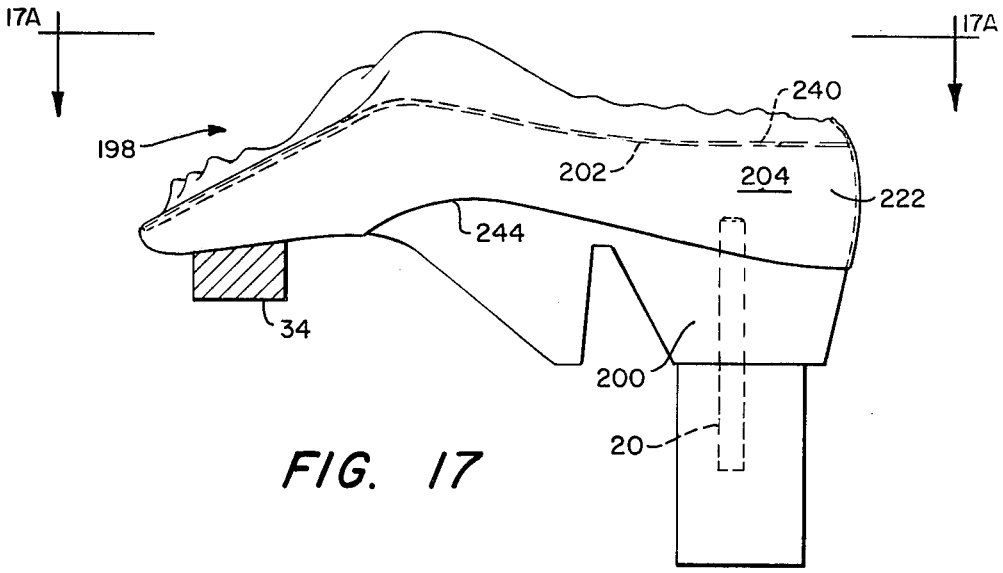
FIG. 17 is a side view of the shoe assembly as it appears in the machine at the beginning of a machine cycle.
Figure 17A:
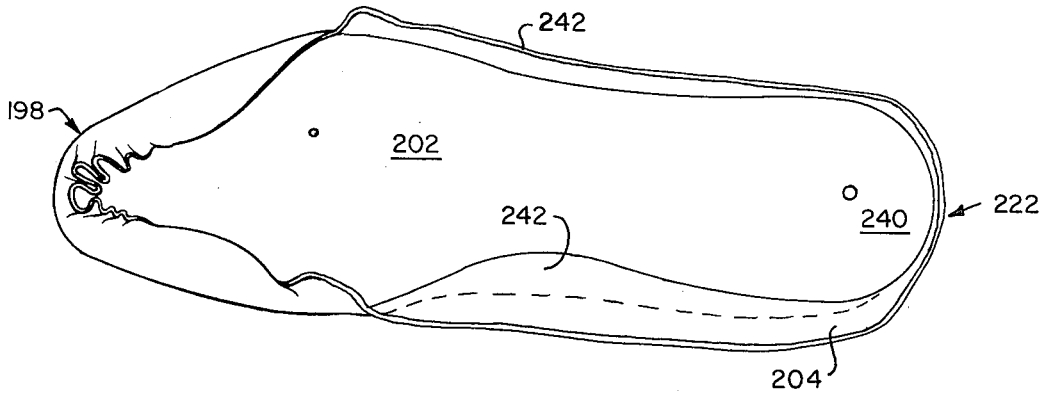
FIG. 17A is a view taken along the line 17A—17A of FIG. 17.

A shoe assembly 198 (FIGS. 17 and 17A) comprising a last 200 having an insole 202 located on its bottom and an upper 204 mounted thereon is placed bottom-up on the support 44 with the vamp of the shoe assembly resting on the toe rest 34 between upstanding toe rest flanges 205 (FIG. 1) and with the last pin 14 inserted into the thimble in the back portion of the last so that the toe of the shoe assembly faces forwardly. Prior to placement in the machine, the shoe assembly 198 had been toe lasted. In FIGS. 17 and 17A, the shoe assembly 198 is illustrated as being for a left foot and the machine operating cycle described below will be for a left foot shoe assembly.

The machine includes left and right control knobs 206 (FIG. 1), each of which is mounted to a post 208 at the front of the machine. Referring to FIG. 16, the left control knob 205 is connected to a valve 210 and the right control knob 206 is connected to a valve 212 in the manner shown in U.S. Pat. No. 3,831,216. The operator now momentarily depresseses the left control knob 206 to thereby momentarily open the valve 210. This causes a pulse of air to flow from a source 214 through the valve 210 and a pilot line 216 to the right side of a valve 218 to shift the valve 218.

The motor 66 on the left side of the machine, as viewed in FIG. 1, is designated 66L in FIG. 16 and the motor 66 on the right side of the machine, as viewed in FIG. 1, is designated 66R in FIG. 16.

The shifting of the valve 218, pursuant to the flow of the pulse of pressurized air through the line 216, enables pressurized air to flow from the source 214 through the valve 218 and lines 220 to 222 to the rod end of the motor 39 to thereby cause the motor 39 to retract its piston rod 40 and thereby swing the work support 44 rightwardly as seen in FIG. 1 and counterclockwise as seen in FIG. 3 about the axis of the pivot pin 16 until the left wing 35 as seen in FIG. 1 and the upper wing 35 as seen in FIG. 3 engages the cam 36. The cam 36 had been so adjusted in forward-rearward directions that the periphery of the heel portion 222 of the left foot shoe assembly 198 is symmetrical about the forward-rearward axis of the machine about the same line of symmetry as the heel wipers 186 when the wing 35 referred to in the preceding sentence engages the cam 36. This symmetrical relationship ensures that the heel wipers will efficiently perform the heel wiping operation described below. The axis of the pin 16, about which the work support 44, together with the shoe assembly 198, is swung by the motor 39 is in approximate coincidence with the heel end extremity of the shoe assembly, thus ensuring that the periphery of the heel portion 222 of the shoe assembly 198 is in the desired symmetrical location when it has completed its swing about the axis of the pin 16 for the left foot shoe assembly as described here and for the right foot shoe assembly as described below.

The aforementioned shifting of the valve 218 also enables pressurized air to flow from the line 220 through a line 224 to the blind end of the motor 66L and to the rod end of the motor 66R. This causes the piston rod 68 of the motor 66L to be projected from this motor so as to bring the inner section 74 of the lever 72 on the left side (FIG. 1) of the machine into registration with its associated rod 78 and causes the piston rod 68 of the motor 66R to be retracted into this motor so as to bring the outer section 76 of the lever 72 on the right side (FIG. 1) of the machine into registration with its associated rod 78 for reasons set forth below.

Referring to FIGS. 2 and 3, the bar 22, together with the support 44, is connected to the piston rod 226 of an air actuated motor 228 that is mounted to the housing 14. A brake plate 230 is connected to the bar 22 for heightwise movement therewith and is located between a pair of brake arms 232 that are pivotally mounted on levers 234. The levers 234 are pivoted to the housing 14 by means of pins 236. The back end of one of the levers 234 is pivotally connected to the piston rod of an air actuated motor 238 and the back end of the other lever 234 is pivotally connected to the cylinder of the motor 238.

In the manner disclosed in the aforementioned application Ser. No. 467,522, the shifting of the valve 210 actuates the motor 228 to raise the bar 22, together with the support 44, to a position wherein the insole heel seat portion 240 (FIGS. 17 and 17A) is located substantially level with the bottoms of the heel wipers 186 in a plane substantially parallel to the plane of movement of the heel wipers 186. After this the motor 238 is actuated to force the brake arms 232 against the brake plate 230 to thereby lock the bar 22 and the support 44 in this position. This is followed by an activation of the motor 166 to move the slide plate 164 forwardly to a forward working position and thereby carry the heel clamp pad 172 and the heel wipers 186 forwardly from their initial out-of-the-way positions, until, in the manner shown in the aforementioned application Ser. No. 467,522, the heel clamp 172 is caused to engage the heel portion 222 of the shoe assembly 198 and clamp the heel portion of the upper 204 against the last and the heel wipers 186 are brought to a position wherein they are close to but not in engagement with the heel portion of the margin 242 of the upper 204 as shown in FIGS. 18 and 18A.

Figure 18:
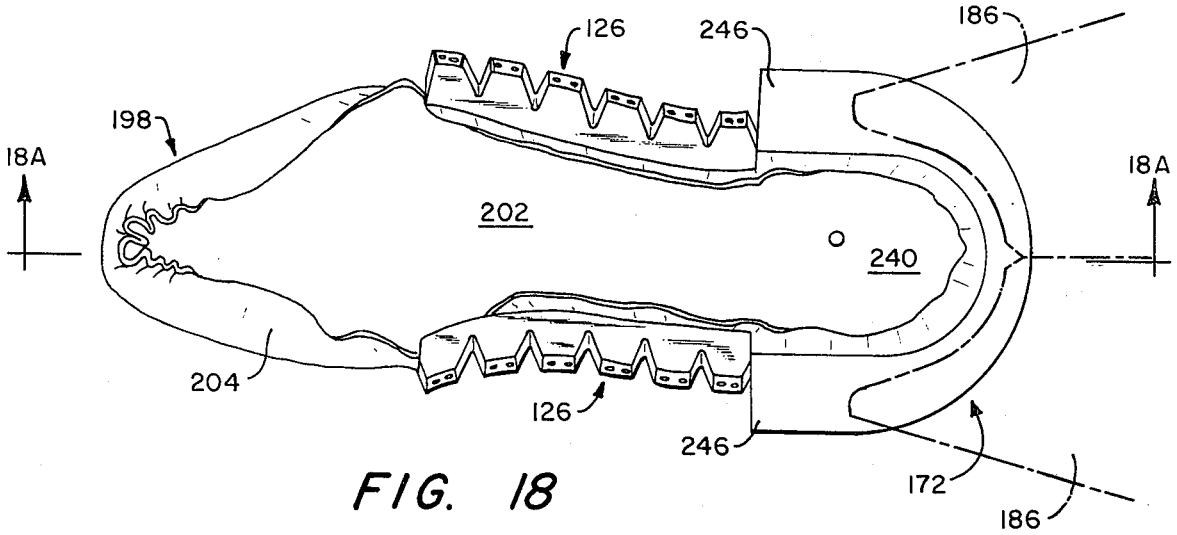
FIG. 18 is a plan view of the shoe assembly as it appears in the machine after the side and heel portions of the upper have respectively been clamped to the last by the side lasting instrumentalities and a heel clamp.
Figure 18A:
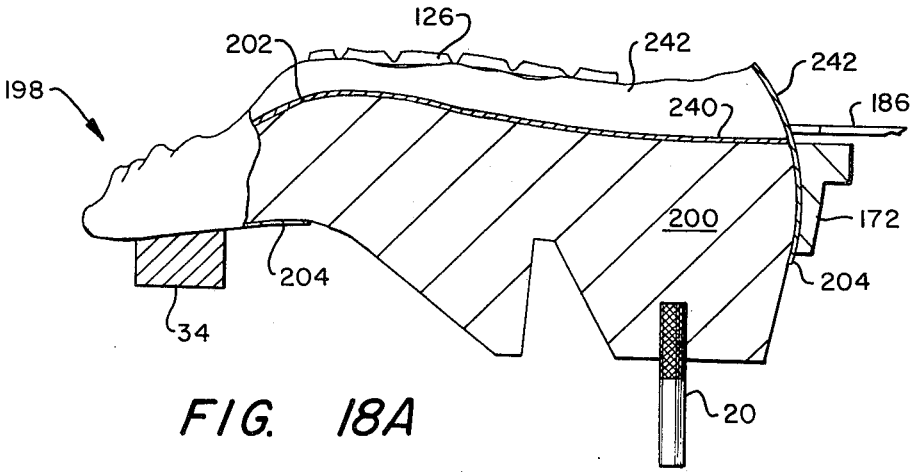
FIG. 18A is a section taken along the line 18A—18A of FIG. 18.

At about the same time as the heel clamp 172 and the heel wipers 186 are brought to the FIGS. 18 and 18A position, the motors 52 are so actuated as to project their piston rods 54 inwardly to thus move the bases 56, together with the sets of lasting units 46, inwardly to positions wherein the rod 78 on the left side (FIG. 1) of the machine engages the inner section 74 of the lever 72 on the left side of the machine and the rod 78 on the right side of the machine engages the outer section 76 of the lever 72 on the right side of the machine. As a result, the lasting instrumentalities 126 are positioned close to but not in engagement with the sides of the shoe assembly 198.

Figure 19:
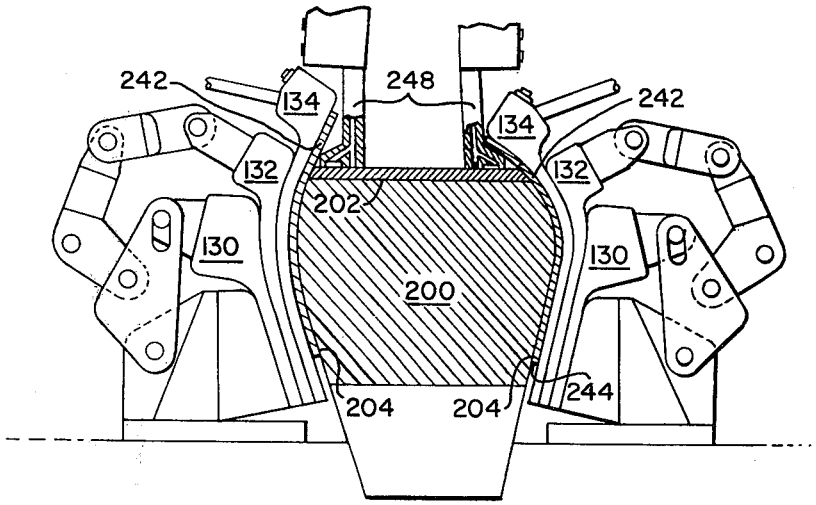
FIG. 19 is a view showing nozzles as they appear when applying cement into the corners between the side portions of the upper margin and the corresponding portions of the insole periphery.

The engagements of the rods 78 with the levers 72 causes the levers to swing inwardly about the axes of the pins 73 and engage the housings 59, this engagement stopping the inward movements of the bases 56 and the sets of lasting units 46 and also causing the levers 72 to move the pins 62 inwardly to thereby move the valve spindles 64 inwardly so as to actuate the valves 58. The actuation of the valves 58 causes an operation of the motors 96 so as to admit pressurized air under relatively high pressure to the blind ends of these motors to thereby enable each piston rod 98 to cause a lasting instrumentality 126 to move inwardly with respect to its support 82 with its inner bracket 90 sliding on the support until the lasting strap bottom segment **134*a* engages and meets resistance from the shoe assembly 198. At this time, since there is no pressurized air in the motors 150, the piston rods 158 are dragged inwardly of the motors 150 during the inward movements of the lasting instrumentalties 126. The lasting strap bottom segments 134*a* engage the side portions of the shoe assembly 198, between its toe and heel portions, wherein the margin 242 of the upper 204 extends away from the insole 202 as shown in FIG. 19. The rigid bottom segment 134*a* straddles the top line 244 of the upper 204 so as to clamp the top line against the last 200. Upon engagement of a bottom segment 134*a* with the shoe assembly 198, the continued force applied by the piston rod 98, through the lever limb 106, causes the lever 102 to swing inwardly about its pivot pin 108. The inward swinging of the lever 102, through the pin and the slot connection 138 and 140, causes the outer presser strap top segment 130*b* to be forced inwardly thus flexing inwardly the outer presser strap middle segment 130*c*. This is followed by an inward swinging of the lever 102 about its pivot pin 108 which, through the lever limb 104 and the link 146, causes the inner presser strap top segment 132*b* to be forced inwardly thus flexing inwardly the inner presser strap middle segment 132*c*.**

It is desired, during the lasting of the shoe, that the top line 244 of the side portions of the upper 204 be clamped against the last 200 and remain stationary on the last while the side portions of the upper extending from the top line towards the last bottom and the insole 202 have any slack and wrinkles taken out and then be pressed tightly against the last. This is accomplished by virtue of the fact that the bottom segment **134*a* first rigidly clamps the top line 244 to the last after which the outer presser strap top segment 130*b* is moved against the shoe assembly followed by a movement of the inner presser strap top segment 132*b* against the shoe assembly. The movement of the presser straps against the shoe assembly causes the lasting strap middle segment 134*c* to flex and press the upper between the top line and the insole bottom against the last while conforming to the shape of the last. Since the outer presser top segment 130*b* is lower than the inner presser strap segment 132*b*, the pressure applied by the lasting strap middle segment 134*c* against the upper commences at its bottom proximate to its rigid bottom segment 134***a* and works its way upwardly. Therefore, the upper is progressively urged upwardly of the top line as it is pressed against the last thus pressing the upper against the last in a wrinkle free manner. At the completion of the pressing of the upper against the last by the lasting strap middle segment 134*c*, the lasting strap top segment 134*b* extends upwardly of the insole 202 and outwardly of the upper margin 242 as indicated in FIG. 19.

From the foregoing it can be seen that, at the time the motors 96 are actuated to move their piston rods 98 inwardly, the lasting instrumentalties 126 must be on opposite sides of the shoe assembly 198 in positions that are close to but not in engagement with the shoe assembly and that these positions are determined by the engagement of the rods 78 with the levers 72. The aforementioned rightward swinging, as seen in FIG. 1, of the shoe assembly 198 about the axis of the pin 16 to bring the heel portion 222 of the shoe assembly into symmetry with the heel wipers 186 causes the right side (the bottom side in FIG. 18) of the shoe assembly to project further from the longitudinal center line of the machine and of the heel wipers 186 than the left side (the top side in FIG. 18) of the shoe assembly. By having the rod 78 on the left side of the shoe assembly engage the inner section 74 of its associated lever 72 and by having the rod 78 on the right side of the shoe assembly engage the outer section 76 of its associated lever 72, the actuation of the motors 52 moves the lasting instrumentalities 126 on the left side of the machine further inwardly than the lasting instrumentalities on the right side of the machine whereby, at the completion of these inward movements of the lasting instrumentalities 126, the lasting instrumentalities on both sides of the machine are spaced approximately the same distance outwardly from the sides of the shoe assembly.

The shoe assembly engaging parts are now in the positions shown in FIGS. 18 and 18A with the heel clamp 172 pressing the heel portion of the upper 204 against the last 200 and the lasting instrumentalities 126 pressing the side portions of the upper against the last, the lasting instrumentalities 126 being located forwardly of the heel clamp 172 with substantially no space between the rearmost lasting instrumentalities 126 and the fronts of legs 246 of the clamp 172.

Now, in the manner disclosed in the aforementioned application Ser. No. 467,522, nozzles 248 (FIGS. 1 and 19) are caused to travel rearwardly in the corners between the upper margin 242 and the periphery of the insole 202 from the boundaries between the wiped toe portion of the upper margin to the heel end extremity of the shoe assembly 198 while cement is extruded frm the nozzles into these corners.

After the cement has been applied in the corners referred to in the preceding paragraph, pressurized air is so applied to the blind ends of all of the motors 150 as to cause each motor 150 to force its piston rod 158 inwardly under relatively high pressure and thereby force the lasting strap top segment 134*b* inwardly over the insole periphery under relatively high pressure. This has the effect of forcing each lasting strap top segment 134*b* inwardly and downwardly to press the side portions of the upper margin 242 against the insole 202. At this time, the rigid lasting strap bottom segments 134*a* are still clamping the top line 244 to the last, and the inward and downward force imparted to the lasting strap top segments 134*b* causes the lasting strap middle segment 134*c* to stretch, while the inner and outer presser straps 132 and 130 maintain their pressure against the shoe assembly 198, to thus force the portion of the upper 204 extending above the top line 244 upwardly and stretch the upper upwardly and tightly about the last while it is conforming to the shape of the last. The pressure applied by the presser straps 130 and 132 is light enough to allow this stretching of the lasting strap middle segments 134*c* to take place. The forcing down of each lasting strap top segment 134*b* against the insole causes the lasting strap top segments 134*b* to wipe or fold the side portions of the upper margin 242 against the insole 202 and bond the upper margin to the insole by means of the previously applied cement.

After the lasting strap top segments 134*b* have forced the side portions of the upper margin 242 against the insole 202 for a sufficient length of time as to enable the side portions of the upper margin to be effectively bonded to the insole, the motors 52, 96 and 150 are actuated to return the sets of lasting units 46 to their idle positions. This is followed by an actuation of the motor 178 to cause the wiper slide 174 to move forwardly thereby imparting motion to the wiper cams 184 and consequently the heel wipers 186 in a heel wiping stroke by means of the links 188. The heel wipers 186 are guided in their movement by the engagement of the cam slots 192 with the rollers 190 in a path that is both forwardly translating and inwardly swinging about the vertex 250 (FIG. 15) of the heel wipers. This causes the heel wipers 186 to engage the heel portion of the upstanding upper margin 242, that extends from the heel end extremity of the shoe assembly 198 to the rearmost ends of the side portions of the upper margin 242 that had been previously wiped against and bonded to the insole by the sets of lasting units 46, and wipe the heel portion of the upper margin against the insole heel seat portion 240 and bond it to the insole heel seat portion by means of the previously applied cement.

At or near the end of the end of the heel wiping stroke the motor 238 is so actuated as to cause the brake arms 232 to disengage the brake plate 230 and thus unlock the support 44 for heightwise movement. At about the same time, air is introduced under increased bedding pressure to the motor 228 to cause the support 44 to be so forced upwardly as to press the wiped heel portion of the upper margin 242 against the bottoms of the heel wipers 186 to thereby flatten the wipped heel portion of the upper margin and enhance the bond between the heel portion of the upper margin and the insole heel seat portion 240. When this bedding pressure has been applied for a sufficient length of time, the machine parts that have not already done so are returned to their idle positions and the machine cycle is completed so that the lasted shoe assembly 198 can be removed from the machine.

When operating on a right foot shoe assembly, the operator will start the machine cycle by momentarily depressing the right control knob 206 (FIG. 1) to thereby momentarily open the valve 212. This causes a pulse of air to flow from the source 214 through the valve 212 and a pilot line 252 to the left side of the valve 218 to shift this valve in the opposite direction from the direction in which it is shifted by means of pressureized air flowing through the pilot line 216. The shifting of the valve 218, pursuant to the pulse of pressurized air through the line 252, enables pressurized air to flow from the source 214 through the valve 218 and lines 254 and 256 to the blind end of the motor 39 to thereby cause the motor 39 to project its piston rod 40 and thereby swing the work support 44 leftwardly as seen in FIG. 1 and clockwise as seen in FIG. 3 about the axis of the pin 16 until the right wing 35 as seen in FIG. 1 and the lower wing 35 as seen in FIG. 3 engages the cam 36 to thus bring the periphery of the heel portion 222 of the right foot shoe assembly into symmetrical relationship with respect to the heel wipers 186.

The shifting of the valve 218, as described in the preceding paragraph, also enables pressurized air to flow from the line 254 through a line 258 to the rod end of the motor 66L and to the blind end of the motor 66R. This causes the piston rod 68 of the motor 66R to be projected from this motor so as to bring the inner section 74 of the lever 72 on the right side (FIG. 1) of the machine into registration with its associated rod 78 and causes the piston rod 68 of the motor 66L to be retracted into this motor so as to bring the outer section 76 of the lever 72 on the left side (FIG. 1) of the machine into registration with its associated rod 78. Therefore, the subsequent actuation of the motors 52 to move the sets of lasting units 46 inwardly causes the rod 78 on the right side (FIG. 1) of the machine to engage the inner section 74 of the lever 72 on the right side of the machine and the rod 78 on the left side of the machine to engage the outer section 76 of the lever 72 on the left side of the machine. The leftward swinging, as seen in FIG. 1, of the right foot shoe assembly about the axis of the pin 16 to bring the heel portion of the shoe assembly into symmetry with the heel wipers 186 causes the left side of the shoe assembly to project further from the longitudinal center line of the machine than the right side of the shoe assembly. By having the rod 78 on the right side of the shoe assembly engage the inner section of its associated lever 72 and by having the rod 78 on the left side of the shoe assembly engage the outer section of its associated lever 72, the lasting instrumentalities 126 are brought by the motors 52 to the desired positions close to but not in engagement with the sides of the right foot shoe assembly prior to the actuation of the lasting instrumentalities 126 to last the side portions of the right foot shoe assembly.

In all other respects, the machine cycle in operating on a right foot shoe assembly is identical to the above described machine cycle for operating on a left foot shoe assembly.

There follows below a recapitulation of those portions of the machine construction and the machine cycle that form the basic components of this invention.

The heel wipers 186 constitute heel wiping means that are symmetrically disposed about a forwardly-rearwardly extending line of symmetry 260 (FIG. 15) and are mounted for forward movement from the retracted position shown in FIGS. 18 and 18A to an advanced position in a heel wiping stroke.

The work support 44 constitutes support means that so supports the shoe assembly 198 bottom-up that the heel portion 222 of the shoe assembly faces the heel wiping means 186 and is located forwardly of the heel wiping means when the heel wiping means is in its retracted position so that the heel wiping stroke causes the heel wiping means 186 to wipe the heel portion of the margin of the upper 242 against the insole heel seat portion 240. The support means 44 is mounted to the housing 14 and the housing 14 is mounted for swinging movement about the upright axis of the pin 16 with the support means 44 located forwardly of this axis. The swinging mounting of the housing 14 enables the heel portion 222 of the shoe assembly 198 to be shifted transversely of the line of symmetry 260.

The bases 56 are located outwardly of and on opposite sides of the support means 44 and forwardly of the heel wiping means 186, each base being mounted for inward movement in a base stroke from an outer base position to an inner base position. The rods 78 constitute impact members and the levers 72 constitute stop members. The stop members 72, which are mounted for forward-rearward adjusting movement, each has an inner section 74 and an outer section 76, the inner sections being closer to the line of symmetry 260 than the outer sections. The impact members 78, which are located outwardly of the stop members 72 and are in registry with the stop members, are mounted to the bases 56 for inward-outward movement in unison with the bases. Each set of stop members 72 and impact members 78 constitutes a limit stop means so constituted that it serves, depending on which of the sections 74 and 76 is in registry with the impact member 78 pursuant to forward-rearward adjustment of the stop members, to define a close inner base location that is relatively close to the line of symmetry 260 or a remote inner base location that is relativelyy remote from the line of symmetry 260.

The side lasting instrumentalities 126 are mounted to their associated bases 56 for inward-outward movement and are so constructed as to enable each side lasting instrumentality, when it is moved inwardly of an outer position on its associated base, to perform operations on its associated side portion of the shoe assembly 198 that includes engaging its associated side portion of the shoe assembly and wiping the margin 242 of its associated side portion of the upper 204 against the insole 202.

The valves 210 and 212, the motor 39 for swinging the housing 14 about the axis of the pin 14, and the motors 66 for moving the stop members 72 in forward-rearward directions so as to place either an inner section 74 in registry with an impact member 78 or an outer section 76 in registry with an impact member comprise control means that are actuable to concomitantly selectively shift the support means 44 about the axis of the pin 16 so as to swing the heel portion of the shoe assembly 198 in a particular direction that is transverse to the line of symmetry 260 and that points to a particular side of the line of symmetry and to so actuate the limit stop means 72, 78 as to place the inner base position of the base position of the base on this particular side of the line of symmetry in its close location and the inner base position of the other base in its remote location.

In a machine cycle, the motor 178 and the controls therefor serve as means to initially maintain the heel wiping means 186 in its retracted position, the motors 52 and the controls therefor serve as means for initially maintaining each base 56 in its outer position, and the motors 96 and 150 and the controls therefor serve as means for initially maintaining each side lasting instrumentality 126 in its outer position with respect to its associated base 56. Thereafter the control means are actuated by opening the valve 210 or 212 and thereafter each base 56 is moved through its base stroke by means comprised of the motors 52 and the controls therefor. Thereafter by means comprised of the motors 96 and 150 and the controls therefor each side lasting instrumentality 126 is moved inwardly of its outer position with respect to its associated base to perform the operations described above on the shoe assembly. After the actuation of the control means a heel wiping stroke is imparted to the heel wiping means by the motor 178 and the controls therefor.

I claim:

1. A lasting machine comprising: heel wiping means, symmetrically disposed about a forwardly-rearwardly extending line of symmetry, mounted for forward movement from a retracted position to an advanced position in a heel wiping stroke; support means for so supporting bottom-up a shoe assembly, formed of a last having an upper mounted thereon and an insole located on its bottom, that the heel portion of the shoe assembly faces the heel wiping means and is located forwardly of the heel wiping means when the heel wiping means is in its retracted position whereby the heel wiping stroke causes the heel wiping means to wipe the heel portion of the margin of the upper against the insole, said support means being so movably mounted as to enable the heel portion of the shoe assembly to be shifted transversely of said line of symmetry; a base located outwardly of and on each side of the support means and forwardly of the heel wiping means, each base being mounted for inward movement in a base stroke from an outer base position to an inner base position; limit stop means associated with each base for so adjusting its associated inner base position that the inner base position of its associated base may be in a close inner base location that is relatively close to said line of symmetry or in a remote inner base location that is relatively remote from said line of symmetry; a side lasting instrumentality, mounted to each base for inward-outward movement, so constructed as to enable it when it is moved inwardly of an outer position on its associated base to perform operations on its associated side portion of the shoe assembly that include engaging its associated side portion of the shoe assembly and wiping the margin of its associated side portion of the upper against the insole; control means actuable to concomitantly selectively shift the support means so as to shift the heel portion of the shoe assembly in a particular direction that is transverse to said line of symmetry and that points to a particular side of said line of symmetry and to so actuate the limit stop means as to place the inner base on said particular side of said line of symmetry in its close location and the inner base position of the other base in its remote location; means for initially maintaining the heel wiping means in its retracted position; means for initially maintaining each base in its outer base position; means for initially maintaining each side lasting instrumentality in its outer position with respect to its associated base; means for thereafter actuating said control means; means for thereafter moving each base through its base stroke; means for thereafter moving each side lasting instrumentality inwardly of its outer posititon with respect to its associated base to perform said operations on the shoe assembly; and means, operative after said actuation of said control means, for imparting a heel wiping stroke to said heel wiping means.

2. The machine as defined in claim 1 wherein each of said limit stop means comprises: a stop member, mounted for forward-rearward movement, having an inner section and an outer section, said inner section being closer to said line of symmetry than said outer section; and an impact member, located outwardly of said stop member in registry with said stop member, mounted to its associated base for inward-outward movement in unison therewith; and wherein said control means comprises: means for moving the stop members in forward-rearward directions so as to place either an inner section in registry with an impact member, whereby engagement of an impact member with an inner section defines said close inner base location, or an outer section in registry with an impact member, whereby engagement of an impact member with an outer section defines said remote inner base location.

3. The machine as defined in claim 1 further comprising: a housing mounted for swinging movement about an upright axis; means mounting the support means to the housing forwardly of said axis, said swinging mounting of the housing providing said movable mounting of the support means; and wherein said control means comprises: means for swinging the housing about said axis.

4. The machine as defined in claim 1 further comprising: a housing mounted for swinging movement about an upright axis; and means mounting the support means to the housing forwardly of said axis, said swinging mounting of the housing providing said movable mounting of the support means; wherein each of said limit stop means comprises: a stop member, mounted for forward-rearward movement, having an inner section and an outer section, said inner section being closer to said line of symmetry than said outer section; and an impact member, located outwardly of said stop member in registry with said stop member, mounted to its associated base for inward-outward movement in unison therewith; and wherein said control means comprises: means for swinging the housing about said axis; and means for moving the stop members in forward-rearward directions so as to place either an inner section in registry with an impact member, whereby angagement of an impact member with an inner section defines said close inner base location, or an outer section in registry with an impact member, whereby engagement of an impact member with an outer section defines said remote inner base location.

5. A lasting machine comprising: heel wiping means, symmetrically disposed about a forward-rearwardly extending line of symmetry, mounted for forward movement from a retracted position to an advanced position in a heel wiping stroke; a housing mounted for swinging movement about an upright axis; support means mounted to the housing forwardly of said axis for so supporting a shoe assembly, formed of a last having an upper mounted thereon and an insole located on its bottom, that the heel of the shoe assembly faces the heel wiping means and is located forwardly of the heel wiping means when the heel wiping means is in its retracted position whereby the heel wiping stroke causes the heel wiping means to wipe the heel portion of the margin of the upper against the insole; means for initially maintaining the heel wiping means in its retracted position; means for thereafter so swinging the housing about said axis as to bring the heel portion of the shoe assembly into symmetrical relationship with said line of symmetry; and means for thereafter imparting a heel wiping stroke to said heel wiping means.

6. A method of heel lasting by means of heel wiping means that are symmetrically disposed about a forwardly-rearwardly extending line of symmetry and that are mounted for forward movement from a retracted position to an advanced position in a heel wiping stroke comprising: so supporting by support means a shoe assembly formed of a last having an upper mounted thereon and an insole located on its bottom that the heel of the shoe assembly faces the heel wiping means and is located forwardly of the heel wiping means when the heel wiping means is in its retracted position whereby the heel wiping stroke causes the heel wiping means to wipe the heel portion of the margin of the upper against the insole; initially maintaining the heel wiping means in its retracted position; thereafter so swinging the support means about an upright axis that is in approximate coincidence with the heel end of the shoe assembly as to bring the heel portion of the shoe assembly into symmetrical relationship with said line of symmetry; and thereafter imparting a heel wiping stroke to said heel wiping means.

* * * * *

UNITED STATES PATENT OFFICE

CERTIFICATE OF CORRECTION

PATENT NO. : 3,934,294

DATED : January 27, 1976

INVENTOR(S) : Walter Vornberger

It is certified that error appears in the above-identified patent and that said Letters Patent are hereby corrected as shown below:

Column 2: line 25, change the first occurrence of "said" to --side--; line 38, before "means" insert --wiping-- and change "with" to --when--.

Column 9: line 53, after "margin" insert --and the unwiped side portion of the upper margin--.

Column 12: line 39, change the second occurrence of "14" to --16--.

Signed and Sealed this

*thirteenth* Day of *April 1976*

[SEAL]

*Attest:*

RUTH C. MASON
*Attesting Officer*

C. MARSHALL DANN
*Commissioner of Patents and Trademarks*

Disclaimer 3,934,294.—*Walter Vornberger*, Tewksbury, Mass. LASTING MACHINE AND METHOD. Patent dated Jan. 27, 1976. Disclaimer filed Apr. 26, 1976, by the assignee, *International Shoe Machine Corporation.*

Hereby enters this disclaimer to claims 5 and 6 of said patent.

[*Official Gazette June 15, 1976.*]